US007021402B2

(12) United States Patent
Beato et al.

(10) Patent No.: US 7,021,402 B2
(45) Date of Patent: Apr. 4, 2006

(54) METHOD FOR USING A MULTIPURPOSE UNIT WITH MULTIPURPOSE TOWER AND A SURFACE BLOW OUT PREVENTER

(75) Inventors: Christopher Louis Beato, Missouri City, TX (US); Joop Roodenburg, Delft (NL)

(73) Assignees: Itrec B.V., (NL); Drillmar, Inc., Houston, TX (US)

( * ) Notice: Subject to any disclaimer, the term of this patent is extended or adjusted under 35 U.S.C. 154(b) by 0 days.

(21) Appl. No.: 11/012,781

(22) Filed: Dec. 14, 2004

(65) Prior Publication Data

US 2005/0126790 A1 Jun. 16, 2005

Related U.S. Application Data

(60) Provisional application No. 60/529,519, filed on Dec. 15, 2003.

(51) Int. Cl.
*E21B 29/12* (2006.01)
*E21B 15/02* (2006.01)
*E21B 19/09* (2006.01)

(52) U.S. Cl. ..... 175/7; 175/5; 166/358; 166/345

(58) Field of Classification Search ..... 166/338, 166/345, 349, 351, 352, 358, 363, 364, 367; 175/5, 7, 8
See application file for complete search history.

(56) References Cited

U.S. PATENT DOCUMENTS

| | | | | |
|---|---|---|---|---|
| 3,722,584 | A * | 3/1973 | Nelson | 166/350 |
| 4,059,148 | A * | 11/1977 | Blomsma | 166/359 |
| 5,184,686 | A * | 2/1993 | Gonzalez | 175/5 |
| 5,533,574 | A * | 7/1996 | Gonzalez | 166/358 |
| 5,727,640 | A * | 3/1998 | Gleditsch | 175/7 |
| 6,263,982 | B1 * | 7/2001 | Hannegan et al. | 175/7 |
| 6,325,159 | B1 * | 12/2001 | Peterman et al. | 175/7 |
| 6,415,877 | B1 * | 7/2002 | Fincher et al. | 175/5 |
| 6,557,637 | B1 * | 5/2003 | Dore et al. | 166/338 |
| 6,672,390 | B1 * | 1/2004 | Azancot | 166/341 |
| 6,745,853 | B1 * | 6/2004 | Turner et al. | 175/5 |
| 6,763,889 | B1 * | 7/2004 | Rytlewski et al. | 166/338 |

* cited by examiner

*Primary Examiner*—Thomas A Beach
(74) *Attorney, Agent, or Firm*—Buskop Law Group, P.C.; Wendy Buskop

(57) ABSTRACT

A method of drilling and completing an underwater well entails installing conductor casing from a floating vessel into a seabed; drilling a bore through the conductor casing to a defined depth in the seabed; and installing surface casing through the conductor casing. A high pressure wellhead and mudline suspension system engages the surface casing and are disposed on the first end. The lower stress joint is connected to a lower saver sub that connects to the casing riser's lower end. The casing riser on an upper end is connected to an upper saver sub that engages a upper stress joint. The method ends by connecting the upper stress joint to a surface wellhead in fluid communication with a surface BOP; and connecting the surface BOP and the surface wellhead to a tensioning system on the floating vessel; and using a telescoping joint.

33 Claims, 14 Drawing Sheets

METHOD FOR USING A MULTIPURPOSE UNIT WITH MULTIPURPOSE TOWER AND A SURFACE BLOW OUT PREVENTER

The present application claims priority to co-pending Provisional U.S. Patent Application Ser. No. 60/529,519 filed Dec. 15, 2003, titled "Method For Using a Multipurpose Unit With Multipurpose Tower and a Surface Blow Out Protector".

FIELD

The present embodiments relate to methods of drilling and completing an underwater well.

BACKGROUND

Significant oil and gas reserves have been discovered beneath various bodies of water throughout the world. Originally, the state of technology limited offshore drilling and production to relatively shallow locations in shoreline areas where the depth of the water ranged from a few feet to several hundred feet. The extensive exploration and removal of resources from these near shore regions, coupled with a constant demand for cost effective energy from large, productive reserves, have led to a search for and drilling of oil and gas reserves in locations beneath greater depths of water.

Presently, the industry is conducting drilling operations in depths of 9,000 feet of water, and it is anticipated that these operations will migrate to even deeper waters since the industry has begun leasing blocks for drilling in areas where the depth of water can be ten thousand feet or more. These desires will only grow as technology, such as seismic imaging, continues to progress and identify locations of substantial oil and gas reserves that are buried under even greater depths of water. The industry must still manage the shallower water oil and gas fields that have been or are continuing to be developed. When operating outside the major activity areas such as the Gulf of Mexico or the North Sea, limited drilling vessels are available in the locale so they must be mobilized from great distances around the globe at great cost for relatively short drilling programs.

In the past, shallow-water offshore drilling operations have been conducted from fixed towers and mobile units, such as jack-up platforms. These units are usually assembled on shore and then transported to an offshore drilling site. For a tower unit, the towers are erected over a proposed wellhead and fixed to the marine floor. A jack-up platform may be transported to the site through the use of a barge or through a self-propulsion mechanism on the platform itself. Once the platform is over the proper location, legs on the corners of the barge or a self-propelled deck are jacked down into the seabed until the deck is positioned above the statistical storm wave height. These jack-up barges and platforms drill through a relatively short conductor pipe usually thirty inch (30") in diameter using a surface wellhead in a manner similar to land based operations. Although jack-up rigs and fixed platforms work well in depths of water that total approximately a few hundred feet, they do not work well in deep water operations. The Multi Purpose Unit (MPU) has been designed to work as a tender assisted drilling unit when operating alongside either a shallower water fixed platform or a floating deepwater production platform such as a Spar or TLP. In addition, the multi purpose unit has been designed to work as a stand alone mobile offshore drilling unit from water depths of a few hundred feet to many thousand feet using either a sub surface blow out preventer or a surface blow out preventer.

In a typical conventional offshore drilling operation a thirty inch (30") casing is first jetted into the sea floor and is cemented into position to establish the well. Alternatively a thirty-six inch (36") hole can be drilled and a thirty inch (30") casing can be run and cemented. A twenty-six inch (26") hole section is then drilled through the thirty inch (30") casing. The twenty-six inch (26") drilling assembly is then pulled back to the surface. Then a twenty inch (20") tubular casing is run and landed on the wellhead housing that is attached to the top of the thirty inch (30") casing. The twenty inch (20") casing is then cemented into place. An eighteen and three-quarters inch (18¾") blow out preventer ("BOP") stack is connected to the bottom of a twenty-one inch (21") riser and lowered onto the twenty inch (20") high pressure wellhead housing that is attached to the top of the twenty inch (20") casing. After this operation is completed and the twenty-one inch (21") riser is set, all further drilling actually takes place through the single twenty-one inch (21") riser. This includes drilling a seventeen and one-half inch (17½") hole, running and cementing a thirteen and three-eighths inch (13⅜") casing, drilling a twelve and one-quarter inch (12¼") hole section, running and cementing a nine and five-eighths inch (9⅝") casing, drilling an eight and one-half inch (8½") hole, etc. Casing sizes and designs are program specific and therefore can be applied in many different combinations.

BRIEF DESCRIPTION OF THE DRAWINGS

The detailed description will be better understood in conjunction with the accompanying drawings, wherein like reference characters represent like elements, as follows.

Figure 1:
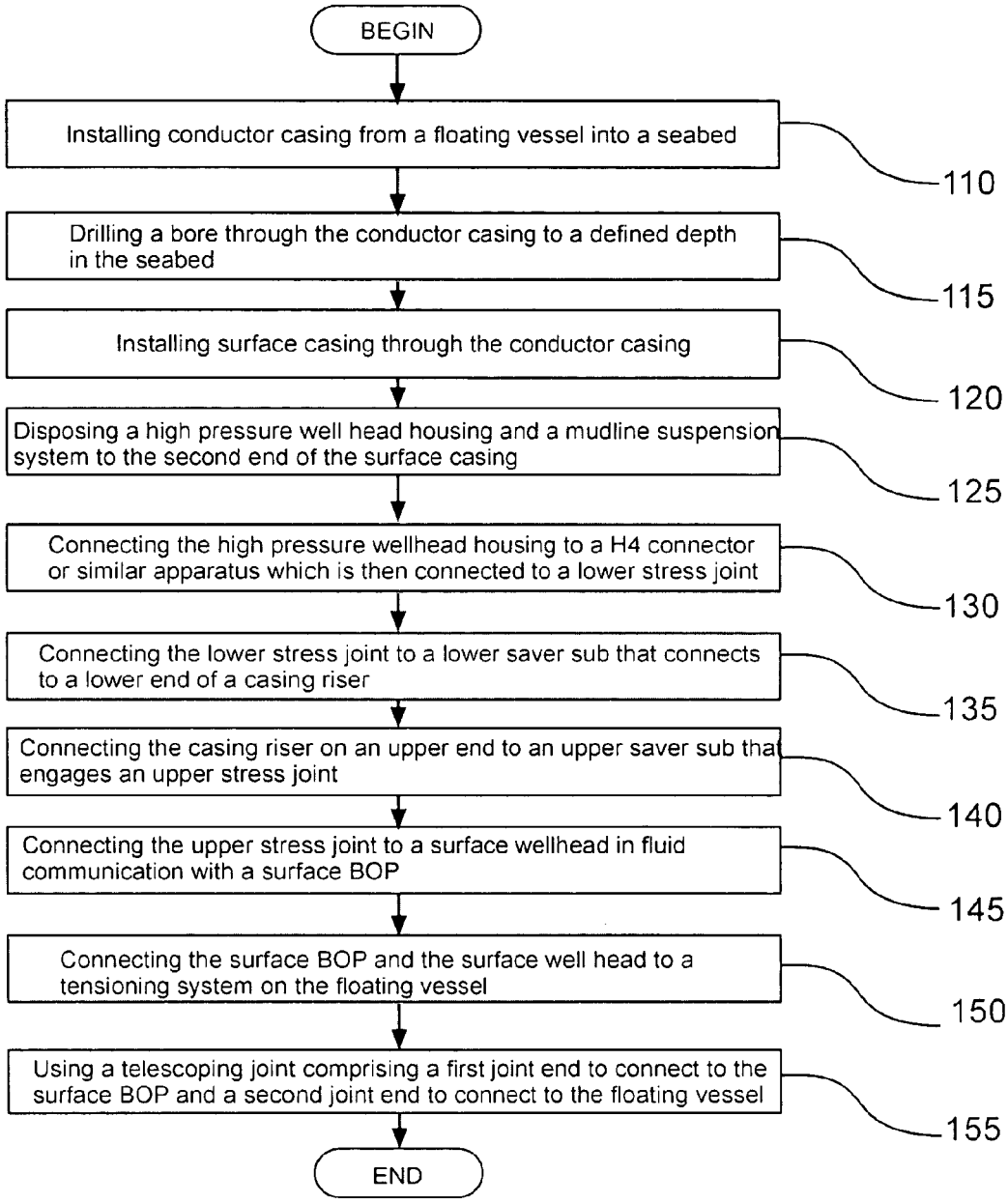
FIG. 1 is a schematic of the method of drilling and completing an underwater well.

The present method is detailed below with reference to the listed Figures.

DETAILED DESCRIPTION OF THE PREFERRED EMBODIMENTS

Before explaining the present method in detail, it is to be understood that the method is not limited to the particular embodiments and that it can be practiced or carried out in various ways.

An embodiment of the invention is for a method of drilling and completing an underwater well using a surface blow out perventer.

A surface blow out preventer is lighter weight than a subsurface BOP and can be maintained without difficulty or the need of an remote operated vehicle (ROV), or without the need to pull and entire riser stack to perform maintenance on the BOP. Typically, a BOP must be tested weekly during drilling and in a typical method, the a BOP testing tool is run in the BOP, the BOP is tested, and the BOP testing tool is retrieved. This process is done at water depths up to 5000 meters and is difficult and time consuming to perform. A surface BOP enables testing of the BOP to be done on the surface without extensive running of the testing tool.

Additionally, if a problem is discovered with the surface BOP, the entire stack does not need to be pulled from the sea floor in order to repair the BOP, instead, with this method the BOP can be promptly repaired on the drill floor.

In another embodiment of the invention, the surface BOP can be combined with a device called the "M3." The M3 device enables skidding to and from the firing line of the drilling operation, as well as lifting of the BOP while tensioning the casing or risers. This embodiment allows for the use of smaller diameters casings or risers, which enables high pressure wells to be drilled. This embodiment also provides a more versatile drilling system that can drill both high and low pressure wells.

The surface blow out preventer with the M3 and the small diameter casing allows drilling to be performed at pressures over 15K. This enables casing and risers to be run in a manner similar to drilling a well using a jack up drilling rig, which is very simple and easy compared to drilling from a floating platform in very deep water.

A surface blow out preventer allows for either the retrofitting of existing drilling systems or the increased versatility in drilling wells.

For the embodiment that uses a surface blow out preventer with an M3 device, the M3 device includes a BOP transporter with an optional lifting device, gas bottles, and a wire storage wheel in a one piece movable structure.

The one piece M3 structure allows for more efficient control of fluid through the system and better reliability due to the parts not being able to separate.

The M3 device reduces environmental impact and reduces the down time of a drilling rig when beginning a new task. This system allows for the entire system to be skidded in an out of the drilling firing line.

The M3 device results in less environmental impact do to the redundancy created by having the ability to move the entire BOP to a new drilling floor by skidding the entire M3 device. By skidding the device the casing does not need to be removed saving fuel and time that would be required to remove the extensive amount of casing used in drilling a well. Also, the M3 device allows the BOP and the casing to remain in place while a Christmas tree is attached, also saving the time and the fuel it would need to remove the casing before the Christmas tree is installed. The M3 device also allow the BOP to move vertically within the M3 device to hold a vertical elevation even though the vessel is moving vertically with the sea. This vertical movement prevents harmful environmental impacts from the breaking of the casing do to vertical movement of the BOP.

This method helps save the environment by having an embodiment that uses a mooring system that is less likely to cause a well blow out from extensive movement of the drilling platform. This improved mooring system is very reliable and reduces stress which can cause failures in the drilling components.

Normal drilling vessels have a mooring system or a jacking system that is designed for the 10 year storm event. When a vessel is designed only for a 10 year storm event then several times a year these vessels are blown off location and can potentially cause an oil or gas well blow out when the drilling components fail. The morring system of this invention is designed for the 100 year storm event dramatically reducing the risk of a rig being blow off location and damaging the environment or the shipping industry.

This method takes advantage of a mooring system which uses synthetic mooring lines that hold a vessel stationary in a location without the need for vessel positioning thruster engines and propellers. This mooring system eliminates the use of over 30,000 gallons of diesel fuel per day and reduces the exhaust emissions that would therefore be required when expending 30,000 gallons of diesel fuel.

This method helps save lives by reducing the amount of evacuations that are performed during inclement weather, since in severe storms with this system and method, the crew can be left on the ship and they will survive extreme storms.

Since the mooring system is designed for the 100 year storm event the vessel does not have to be evacuated for cyclonic storms. Typical vessels must be evacuated since their systems are not designed for the 100 year event and therefore would place people in harms way if they were to remain on the vessel. Not having to evacuate vessels is very advantageous because of the dangers in evacuating vessels by boat or helicopter during inclement weather.

A preferred embodiment of the method begins by performing the step of first installing a conductor casing from a floating vessel into a seabed. In this embodiment it is preferred that the conductor casing is secured to a subsea wellhead housing is disposed on the conductor casing.

It should be noted that the floating vessel should use a mooring system that can limit excursions from a designated location to significantly reduce risk of damage to a casing riser.

Next, the system is assembled by drilling a bore through the conductor casing to a defined depth in the seabed. The method contemplates that the drilling can be casing drilling.

After drilling the bore, surface casing is installed through the conductor casing. The surface casing has a first end and a second end, the first end, or the lower end connects to the well, and preferably is cemented into a well. The second end, or upper end connects to a high pressure wellhead housing which additionally engages a mudline suspension system.

The next step is connecting the surface casing to the high pressure wellhead housing and a mudline suspension system, a H4 connector, such as those available from Drillquip of Texas can be used to connect the surface casing.

The H4 connector is then connected to a lower stress joint which then engages a lower saver sub. The lower saver sub in turn engages a lower end of a tubular riser.

The tubular riser engages an upper stress joint on the upper end of the tubular riser. The upper stress joint then engages a surface wellhead which is connected to a surface blow out preventer. The tubular risers of this embodiment can be connected together forming a single piece up to 5000 meters in length, and preferably between 1000 and 2500 meters in length. A tubular riser is typically between 6 to 36 inches in diameter. The upper stress joint can be in the form of a rigid stress joint, a ball joint or a flex joint.

The surface blow out preventer and the surface wellhead can be supported using a tensioning system on the floating vessel. The tensioning system can be part of the M3 device which is more fully described hereafter.

Finally, a telescoping joint can connect to the surface BOP on a first joint end and a floating vessel on a second joint end.

In another embodiment, a system is contemplated which uses a second bore hole drilled through the surface casing to a second depth, which is deeper than the first depth.

Even smaller diameter casing is used to connect to this second bore hole on one end, and the surface wellhead of the first bore, on the other end.

The smaller diameter casing also engages a mudline suspension hanger which is connected to an upper section of the smaller diameter casing. After that the lower section of the smaller diameter casing is suspended from the mudline suspension system that was used for the first bore. The mudline suspension system is located below the high pressure wellhead housing that is connected to the first end of the surface casing via the mudline suspension hanger.

Smaller diameter casing is connected between the mudline suspension hanger and the surface wellhead, wherein the upper section smaller diameter casing is suspended with a casing hanger from the surface wellhead. Additional bore holes can be drilled, creating multiple bore holes, and additional casing can be installed, repeating the process until the desired depth of the bore hole is achieved.

Another embodiment of the method involves using an M3 device with a tensioning system. The M3 device is a skidding system that allows the surface casing to be skidded from and into the drilling firing line while fully under tension.

With reference to the figures, FIG. 1 depicts a schematic of the steps of the method of drilling and completing an underwater well as taught by the method.

Step 1 (110) involves installing the conductor casing into the sea bed.

Step 2 (115) involves drilling through the conductor casing to a defined depth in the seabed.

Step 3 (120) involves installing surface casing through the conductor casing. The surface casing has a first end and a second end. A wellhead and a mudline suspension system engages the surface casing. The method preferably uses a conductor casing having an outer diameter ranging from 8 inches to 54 inches and preferably 16 inches to 36 inches.

Step 4 (125) involves installing a wellhead and a mudline suspension system on the second end of the surface casing.

Step 5 (130) involves connecting the wellhead to a H4 connector or similar apparatus which is then connected to the lower stress joint.

Step 6 (135) involves connecting the lower stress joint to a lower saver sub that connects to the lower end of a casing riser.

Step 7 (140) involves connecting the casing riser an upper saver sub that engages an upper stress joint.

Step 8 (145) involves connecting the upper stress joint to the surface wellhead in fluid communication with a surface blow out preventer.

Step 9 (150) involves engaging a tensioning system on the floating vessel to the surface BOP and a surface wellhead.

Step 10 (155) involves connecting a telescoping joint to the surface BOP on one end and the floating vessel on the other end. The tensioning system preferably is not laterally constrained and can be gimbaled to minimize the lateral load on the stress joint.

The method can entail the additional steps of drilling a second bore hole deeper through the surface casing to a second depth. Then, installing the smaller diameter casing comprised of a lower section of a smaller diameter casing connected to a mudline hanger which is connected to an upper section of a smaller diameter casing. The lower section smaller diameter casing is suspended from a mudline suspension system that is located below the wellhead that is connected to the first end of the surface casing via mudline suspension hanger. The next step could be installing an upper section smaller diameter casing between the mudline suspension hanger and the surface wellhead, wherein the upper section smaller diameter casing is suspended with a casing hanger from the surface wellhead.

The mudline suspension system includes a housing adapted to land with concentrically different diameter casing strings within the housing while supporting the weight of each casing string suspended below. The mudline suspension system preferably comprises a plurality of hangers. The mudline suspension system connects to a lower stress joint that is connected to the subsea wellhead and then the lower stress joint connects to a lower saver sub.

The steps of drilling to the second bore hole and installing the lower section smaller diameter casing can be repeated until the desired depth of the borehole is achieved.

Figure 2:
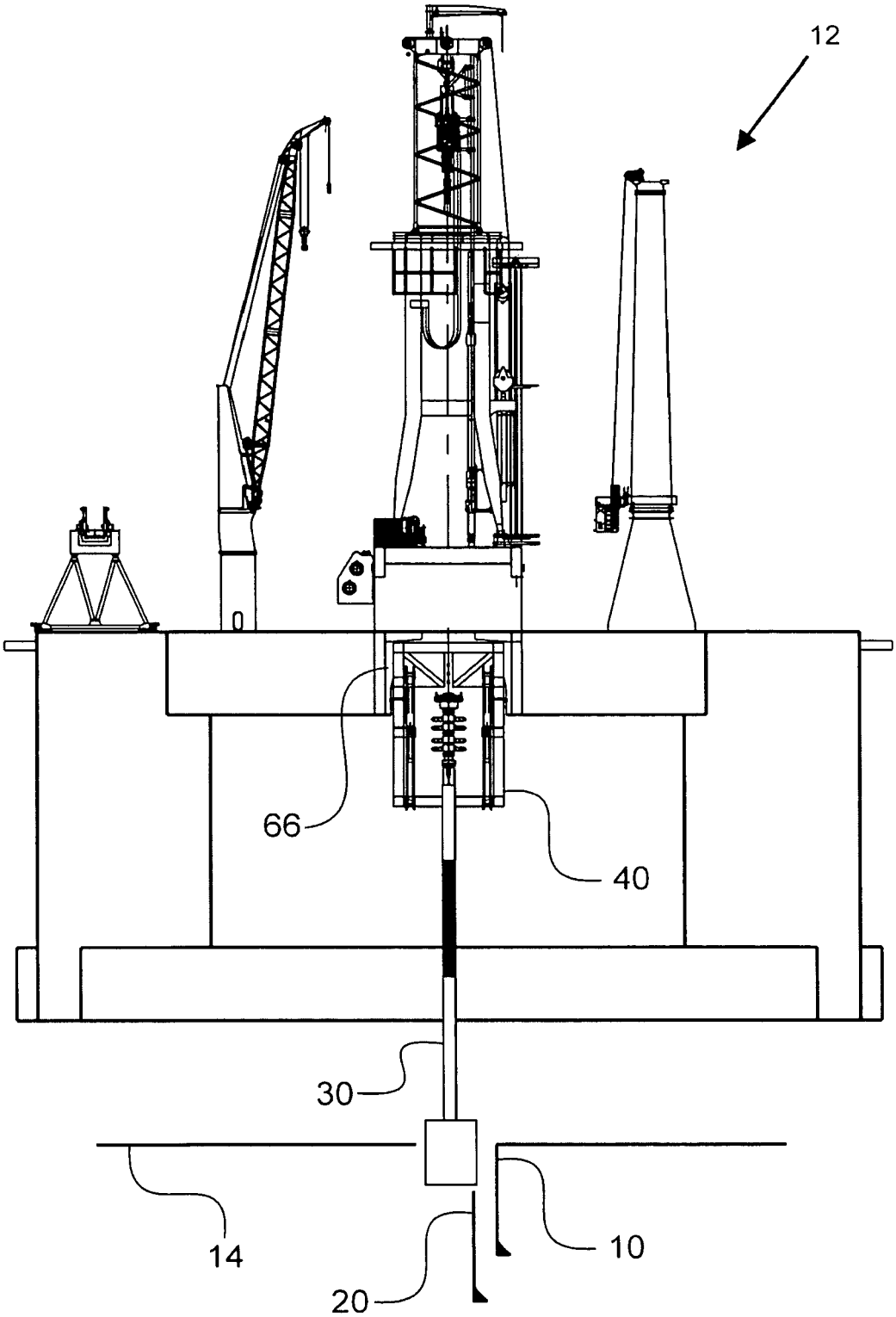
FIG. 2 depicts a side view of a floating vessel with a casing riser extending into the seabed.

FIG. 2 depicts an embodiment of the invention shown from a side view. In this figure is a floating vessel (12) on water with a casing riser (30) extending into the seabed (14). The casing riser (30) is shown connected to a tensioning device, referred to herein as the M3 (40).

The casing riser (30) penetrates the seabed (14) and is connected to a conductor casing (10) and the surface casing (20) beneath the seabed (14). FIG. 2 further depicts the relative position of the M3 (40) and the moon pool (66) with respect to a typical floating vessel (12).

Figure 3:
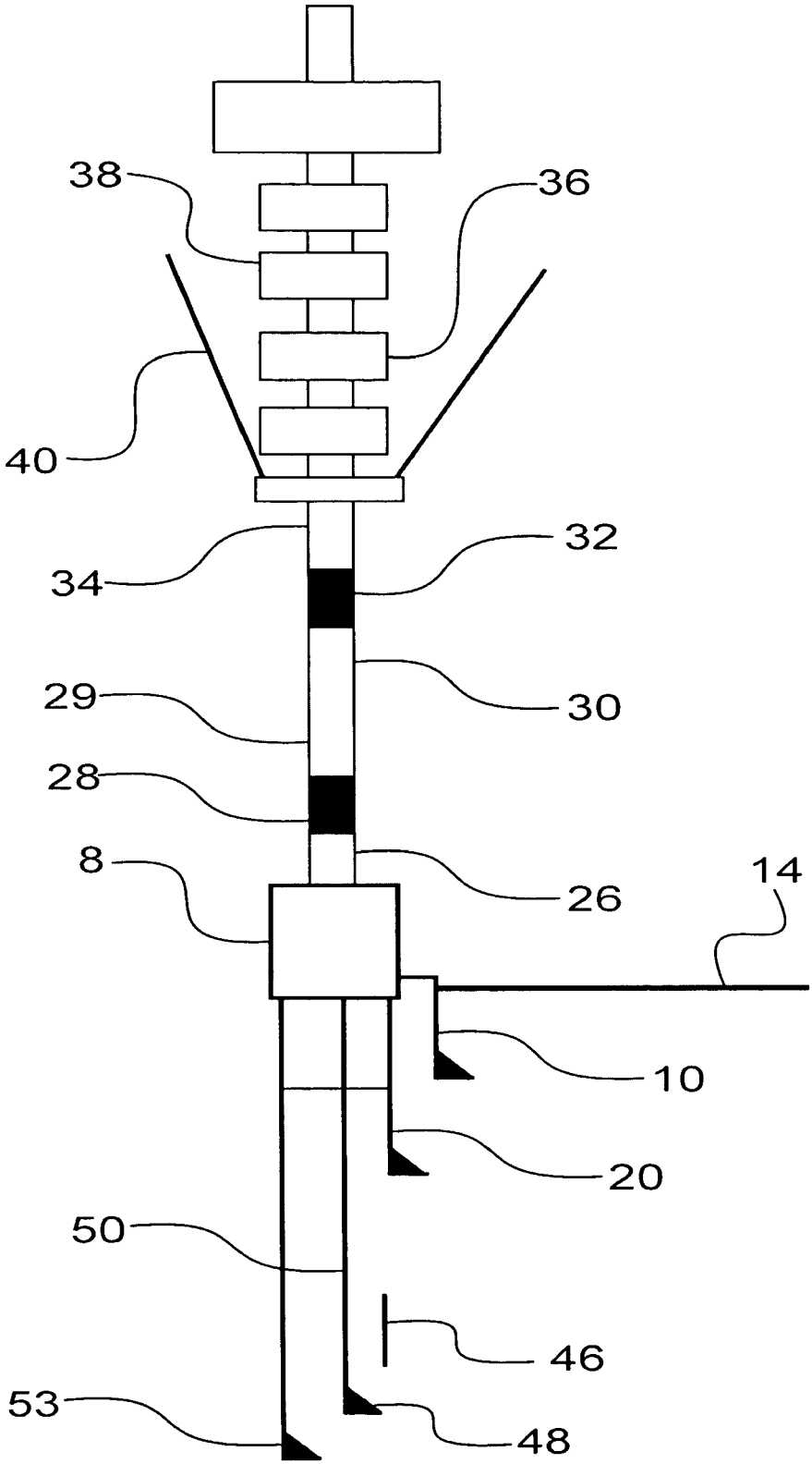
FIG. 3 depicts a side view of a casing riser extending into the seabed with the wellhead housing.

FIG. 3 depicts a side view of a casing riser (30) extending into the seabed (14) with the wellhead housing (8). In this embodiment, a lower saver sub (28) connects to the casing riser's lower end (29) which has the same inner diameter as the surface casing (20).

A stress joint (26) is located between the lower saver sub (28) and a conventional subsea wellhead housing (8) located on the seabed (14). The conductor casing (10) extends from the conventional subsea wellhead housing (8).

An upper saver sub (32) engages an upper stress joint (34) and engages the casing riser (30). The upper stress joint (34) is then connected to a surface wellhead (36). The surface wellhead (36) is in fluid communication with a surface blow out preventer (BOP) (38). The surface BOP (38) and the surface wellhead (36) are connected to the tensioning system (M3 ) (40).

FIG. 3 depicts the embodiment of the system wherein three bore holes of different depths have been drilled. A deeper bore hole (46) is shown through the surface casing (20) to a second depth (48). A lower section smaller diameter casing (50) is installed between the second depth (48) and the mudline suspension hanger (54) not shown in the figure. A still deeper bore hole has been drilled through the surface casing (20) to a third depth (53). More than 3 bore holes can be drilled and implemented in the system of this invention.

Figure 4:
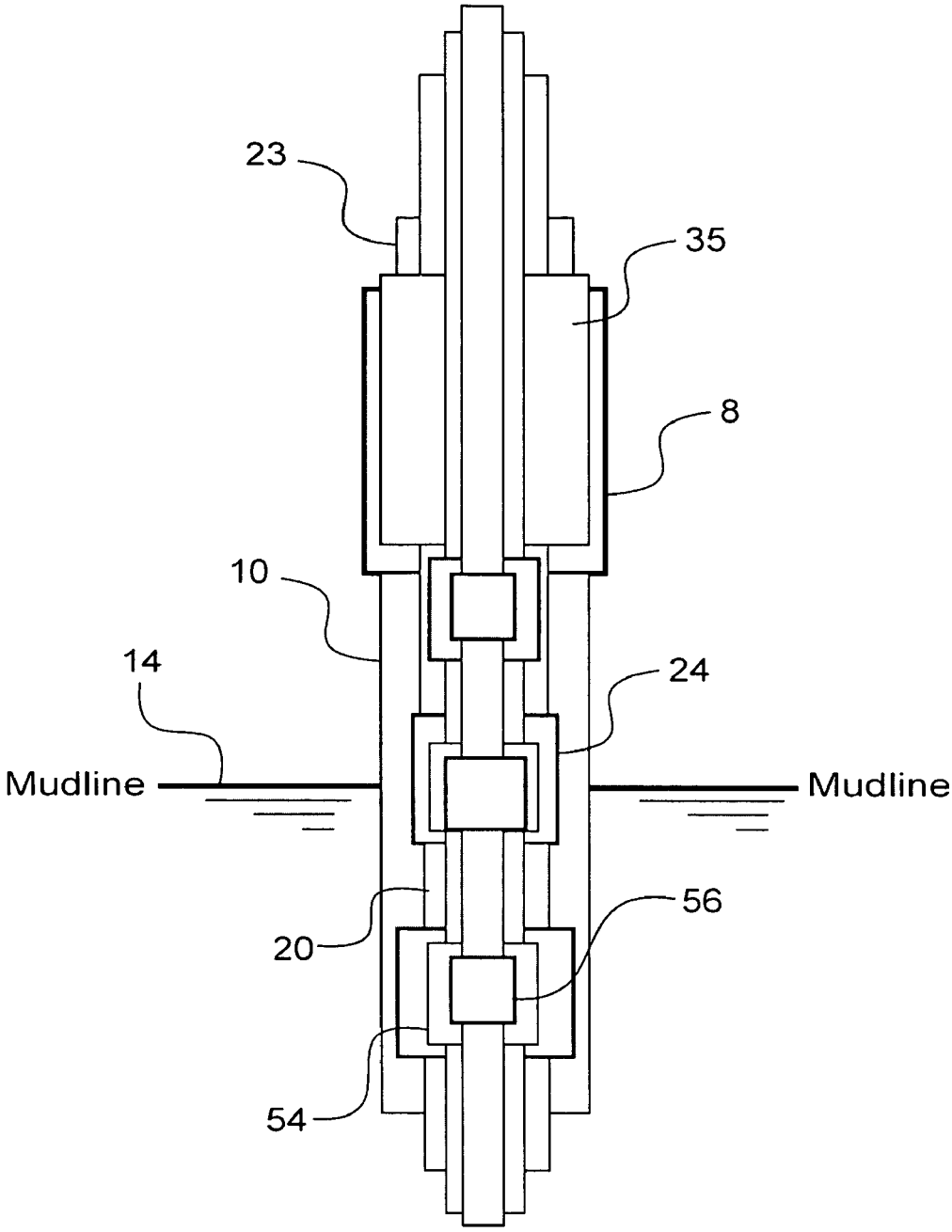
FIG. 4 depicts a cross-sectional side view of the subsea wellhead in the drilling phase.

FIG. 4 depicts details concerning the elements listed above. In FIG. 4, there is a seabed (14) with the conductor casing (10) jetted, drilled or hammered into place in the seabed. A conventional subsea wellhead housing (8) is located approximately 15 ft above the mudline and connected to the conductor casing (10).

Surface casing (20) is connected to a lower stress joint (35). The lower stress joint (35) can be designed to include a H4 connector (23); the H4 connector (23) allows the casing riser to be disconnected without backing out the mudline suspension system (24). The lower stress joint (35) latches to the conventional subsea wellhead housing (8). The lower stress joint (35) is connected to a lower saver sub that can be cost effectively maintained. An upper section smaller diameter casing (56) is installed between the mudline suspension hanger (54) and the surface wellhead.

The conductor casing (10) can be, in a preferred embodiment, a 30 inch conductor housing with a 2000 psi working pressure and, a $1\times10^6$ pound tensile capacity. This housing can be run and cement in a drilled hole or jetted into the seabed.

The H4 connector (23) preferably has a bending capacity of $3.3\times10^6$ ft-lb with 10,000 psi of internal pressure for connecting a 20 inch housing.

The surface casing in a preferred embodiment is a 20 inch housing having a 10,000 psi working pressure exclusive of the lower connection and a $1\times10^6$ lb tensile capacity in running mode.

Figure 5:
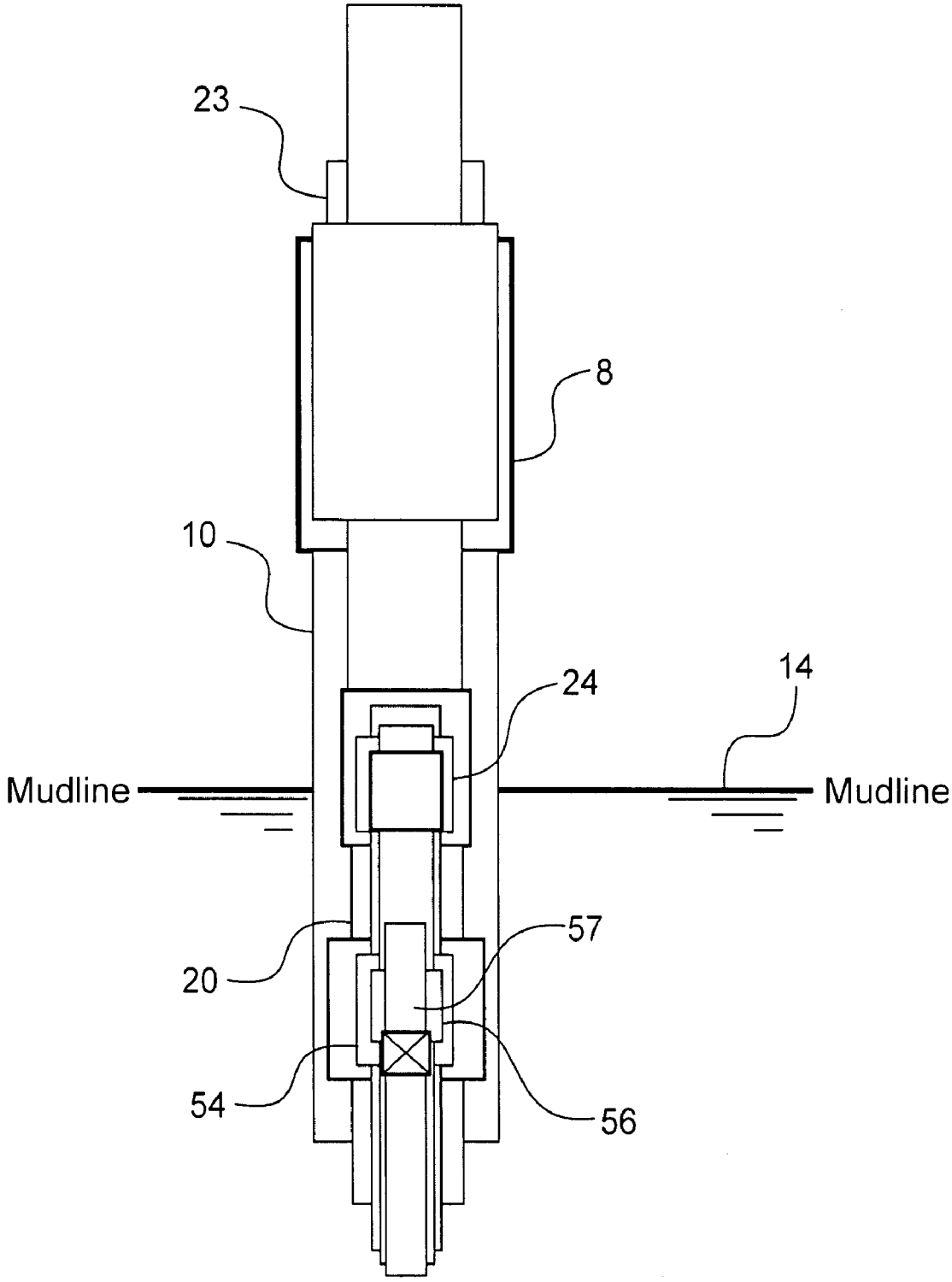
FIG. 5 depicts a cross-sectional side view of the subsea wellhead in the lower completion phase.

FIG. 5 depicts substantially the same parts as FIG. 4 with the addition of a monobore completion (57). The monobore completion (57) has a high pressure polished bore, and is ready to be tied back to the subsea wellhead and subsea Christmas tree.

Figure 6:
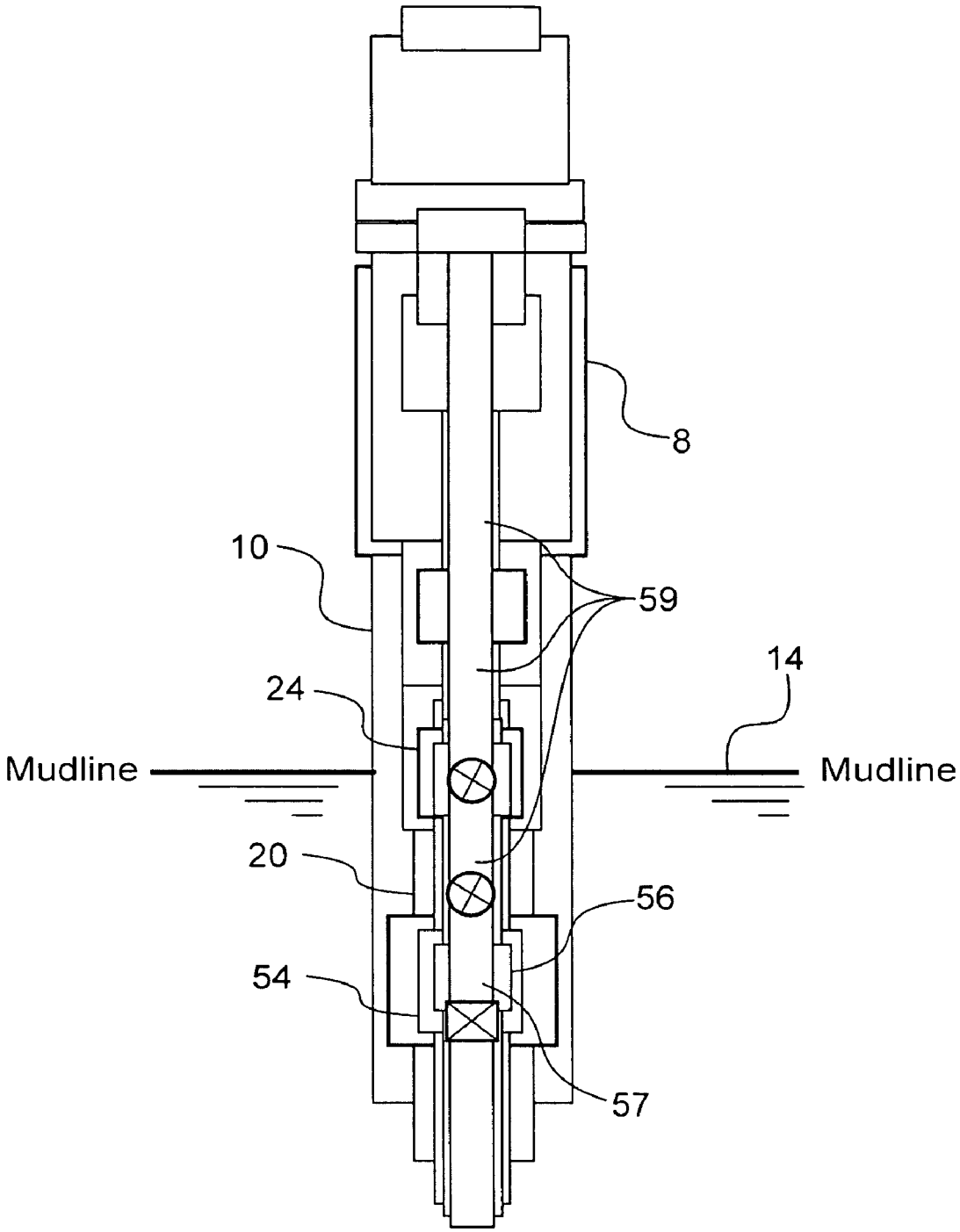
FIG. 6 depicts a cross sectional side view of the subsea wellhead in the final completion phase.

FIG. 6 depicts generally the same parts as FIG. 5 with the exception of the H4 connector (23) and with the addition of a subsea production Christmas tree (59). The lower completion would be tied back to the subsea Christmas tree.

Figure 7:
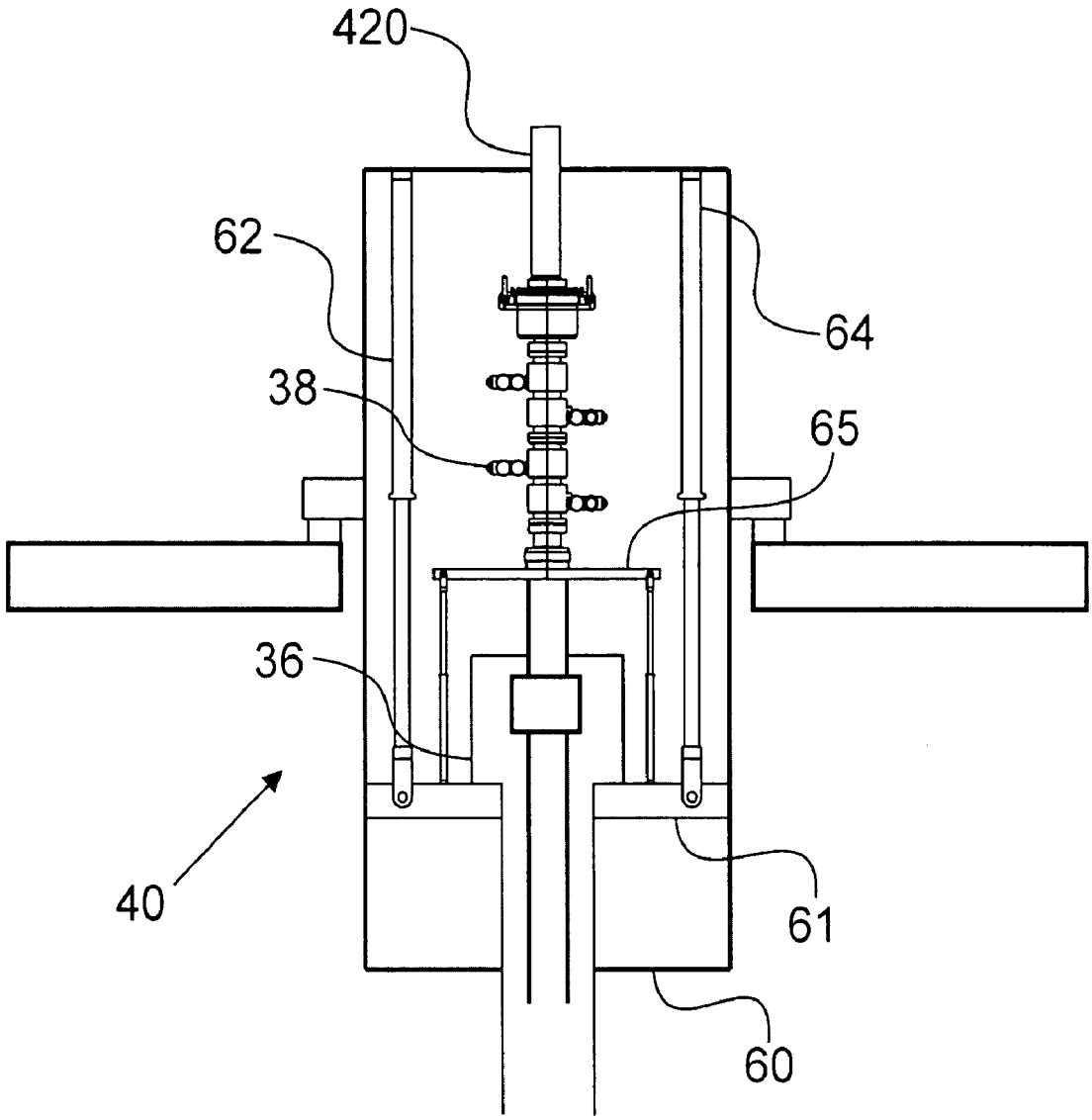
FIG. 7 depicts the tensioning system.

FIG. 7 depicts an embodiment of the tensioning system (M3 ) (40) usable in the method. The tensioning of the surface BOP (38) to the surface wellhead (36) can be by a tensioning system (40) that engages the surface BOP (38) and the surface wellhead (36).

The tensioning system (40) can be constructed from a tensioning frame (60), a tensioning base (61), and two or more tensioning cylinders (62) and (64). The tensioning base (61) is used for supporting the surface wellhead (36), and the surface BOP (38). The tensioning base can be moveably disposed (skiddable) in the tensioning frame (60).

The tensioning cylinders (62) and (64) are individually connected to the tensioning base (61) and are adapted to constraint lateral movement of the tensioning base (61). The tensioning system (40) can include a surface BOP lifting device (65) adapted to lift and support the surface BOP (38) from the surface wellhead (36).

In an alternative embodiment, the tensioning system (40) includes at least two tensioning cylinders (62) and (64) that can be connected to the tensioning base (61) with sheaves and cables. The tensioning of the sheaves and cables can be hydraulically or pneumatically controlled to provide a constant tension on the casing riser (30) not show in FIG. 7.

In another embodiment, a telescoping joint (420) can connect the surface BOP to the floating vessel. The telescoping joint preferably has two ends. The telescoping joint's first end connects to the surface BOP and the telescoping joint's second joint end connects to the floating vessel.

The floating vessel can be a floating caisson, a floating platform, a drill ship, a multipurpose unit (MPU), a tension leg platform or other similar type of floating vessel used in oil and gas exploration. In addition, the method of the invention contemplates that a multipurpose tower (MPT) can be used with the floating vessel (12) forming an MPU or multipurpose unit.

Figure 8:
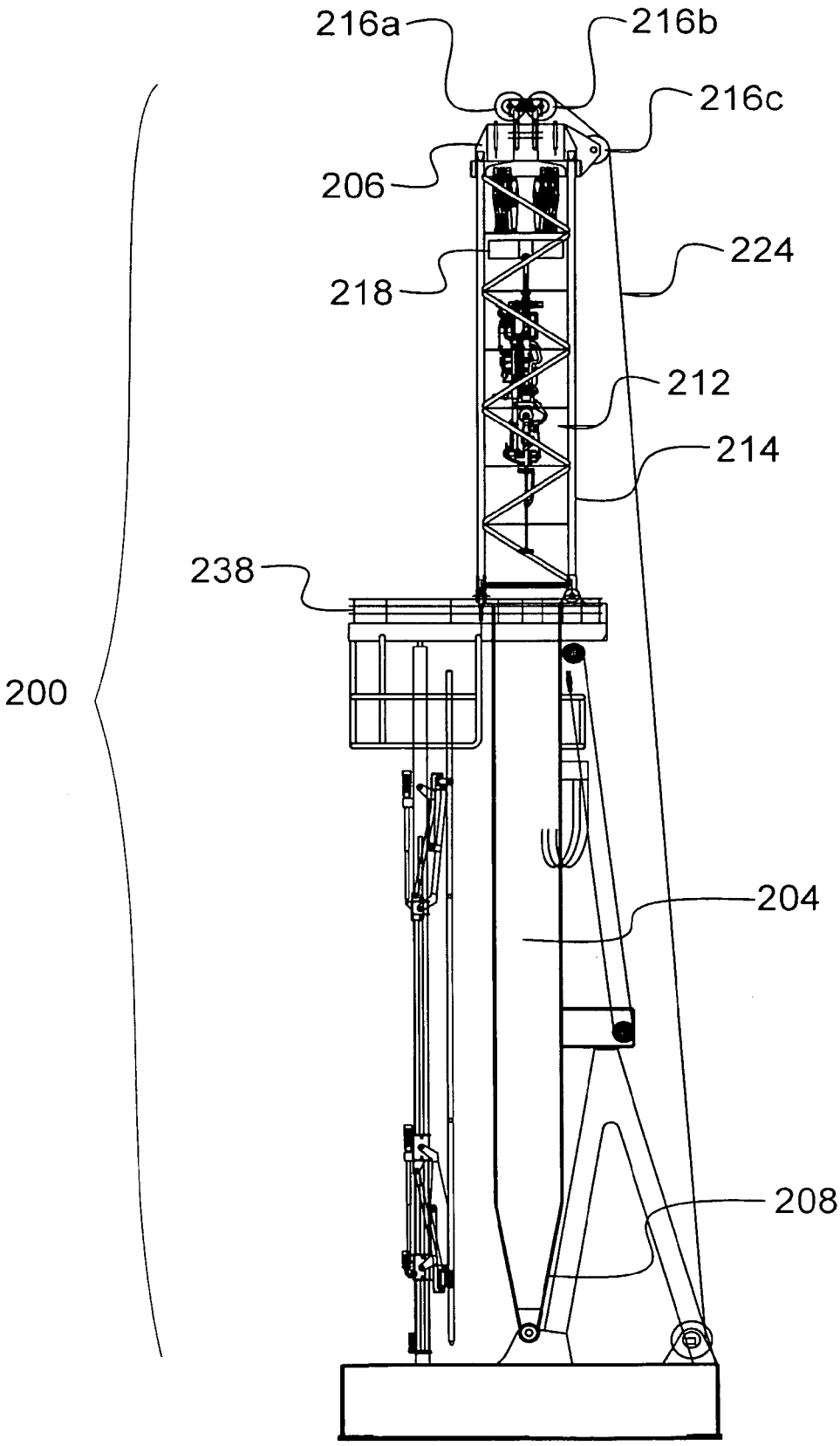
FIG. 8 depicts a detailed side view of the multipurpose tower (MPT) usable in the method.
Figure 9:
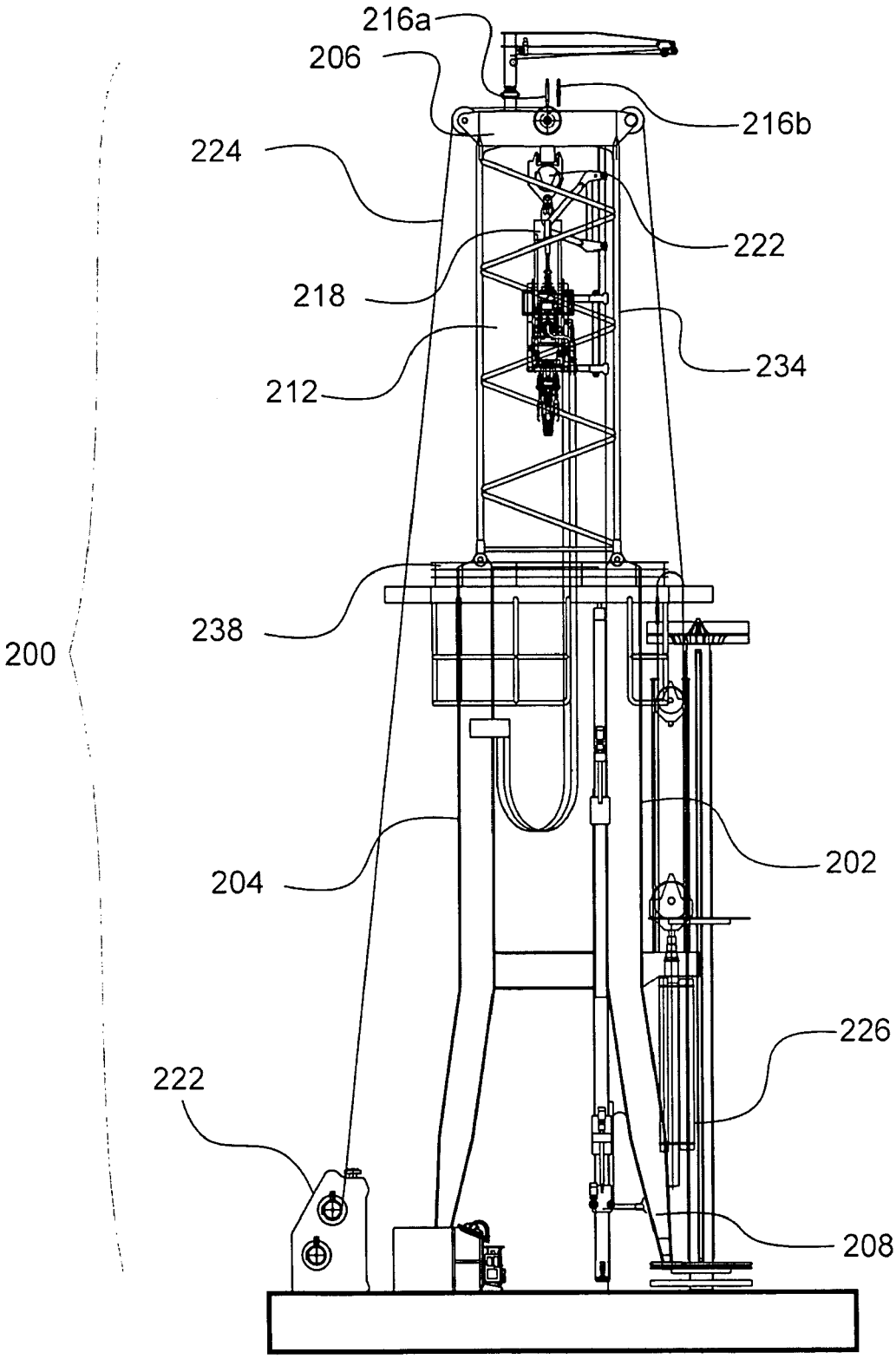
FIG. 9 depicts a detailed front view of the multipurpose tower (MPT) usable in the method.

A typical multipurpose unit (MPU) is shown in a side view in FIG. 8 and a front view in FIG. 9. This embodiment of the multipurpose unit has a mast (200) with two struts, a first strut (202) and a second strut (204). The mast (200) has a mast top side (206), a mast bottom side (208), a mast forward side (210), a mast inward side (212), and a mast back side (214). The MPU can include numerous cable blocks (216*a*), (216*b*), and (216*c*) connected to the mast top side (206). Cable blocks can be used with the MPU mast.

A working area or platform (238) is shown in FIG. 8. The working area or platform (238) can be installed on the multipurpose unit and located inside a lattice structure (234).

A main trolley (218) with a first gripper is moveably connected to the mast inward side (212). One or more main hoists (222) can be connected to the mast (200). A hoisting cable (224) is connected to one of the hoists and is adapted to be guided over the cable blocks (216*a*), (216*b*), and (216*c*). The hoisting cable (224) moves the main trolley (218) vertically up and down the mast (200).

In an alternative embodiment, the multipurpose unit can rotate, or pivot, at the mast bottom side. In yet another embodiment, a compensator (226) can be installed on the multipurpose unit as shown in the front view of the MPT in FIG. 9.

The multipurpose unit can further include an auxiliary trolley, and one or more secondary hoists connected to the mast and the auxiliary trolley. The secondary hoists are adapted to move the auxiliary trolley vertically up and down the mast. The auxiliary trolley itself has a second gripper moveably connected to the mast forward side.

The mast can be supported by cable blocks from the mast top side. The mast top side on the multipurpose unit can have a lattice structure (234) that can either be opened or closed. The main trolley and the auxiliary trolley can move inside the lattice structure (234). In the most preferred embodiment, the trolleys are located within the lattice structure. The main trolley can be connected to the top drive, and the lattice structure can enclose the main trolley and the top drive within the structure. A firing line is located inside the lattice structure. The MPT can alternatively have a firing line and/or a second firing line outside the lattice structure (234).

Figure 10:
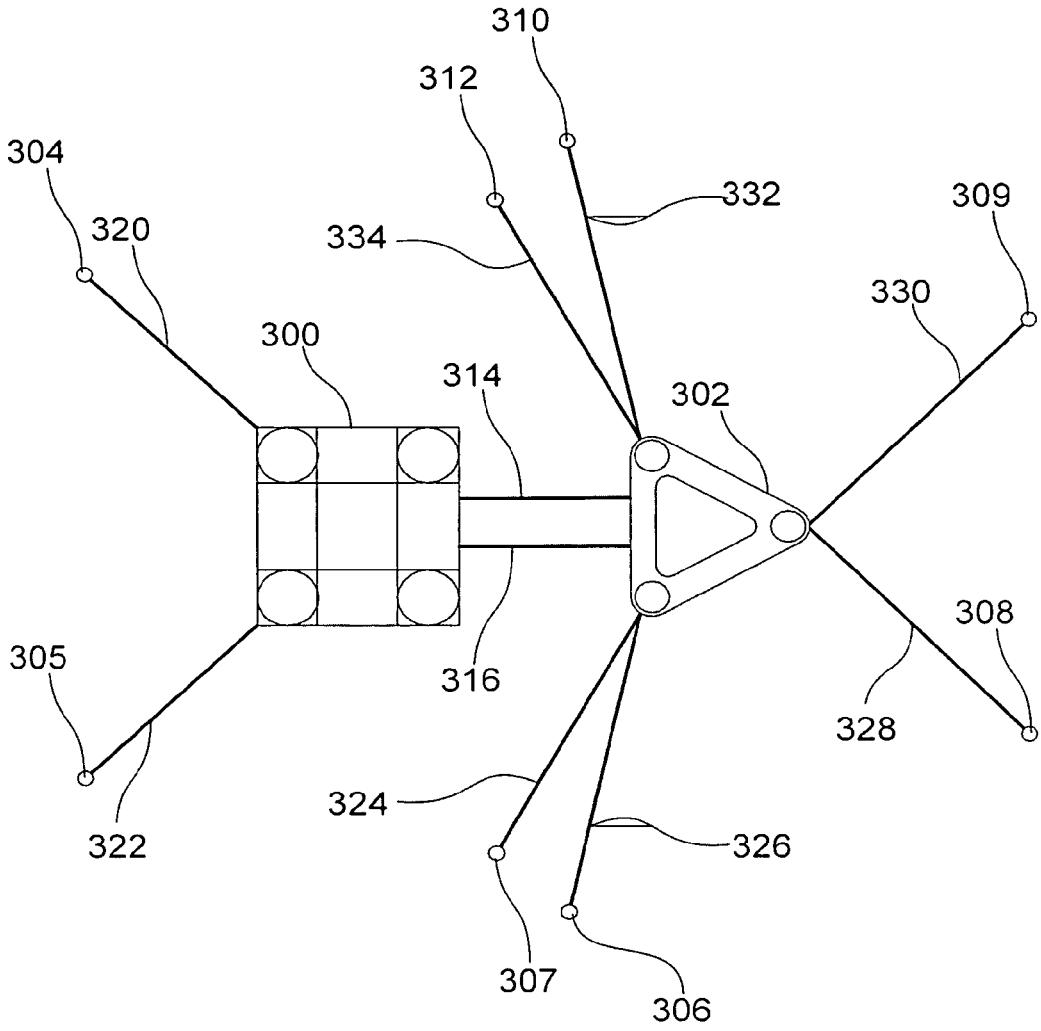
FIG. 10 depicts the mooring system usable in the method.

FIG. 10 depicts a mooring system that can be used with the method. The mooring system can include eight or more anchors (304), (305), (306), (307), (308), (309), (310), and (312) and two or more hawsers (314) and (316) connected from a semisubmersible tender (300) to a floating platform (302), such as a deep draft caisson vessel. The mooring lines (320), (322), (324), (326), (328), (330), (332), and (334) connect the vessels to the anchors (304), (305), (307), (306), (308), (309), (310) and (312) as shown in FIG. 10. Each mooring line is preferably, a first length of steel wire rope secured to each of the anchors and a length of polymer rope secured to each steel wire rope. Each mooring line preferably has a second length of steel wire rope secured to the polymer rope on one end and the tender on the other end.

The exampled mooring system is adapted for a semisubmersible tender with a lightship displacement of less than 20,000 short tons.

The mooring system utilized in this invention is designed to withstand a 100-year storm event and to be stiff enough to minimize the floating vessel excursion to a point where forces applied to elements between the subsurface wellhead and the surface blowout preventer does not exceed any of the drilling components rated working strength or a components defined fatigue limit. The design of the mooring system prevents movement of the MPU or other floating vessel using this system beyond a maximum radius. Even when one of the mooring lines is damaged the mooring system prevents movement beyond the maximum radius so that the tubular riser is not damaged in a storm.

The mooring lines are selected to have adequate elasticity, stiffness, and strength to accommodate the load on the tender under an environmental load produced by up to a 10-year storm condition in the tendering position. The mooring lines have the strength to withstand the environmental load produced by a 100-year extreme weather condition when the tender is moved to a 100-year extreme weather condition standby position. The mooring lines can be adapted to synchronize the movements between the semisubmersible tender and the deep draft caisson vessel, while tendering.

The vessel usable in this invention may have numerous pontoon hulls, preferably three, connected by supports as shown in FIG. 10. The semisubmersible (300) can be a four pontoon square shape; and the floating platform (302) can be a triangular shape with three colums. Each pontoon is capable of transverse ballast transfer and longitudinal ballast transfer. The pontoons can be connected to form a triangular, a rectangular, or a square shape. Regardless of how the pontoons are connected, the ballast in the pontoons can be moved at a transverse ballast transfer rate from 30 and 300 gallons per minute. The ballast in the pontoons can be moved at a longitudinal ballast transfer rate from 180 to 300 gallons per minute.

Figure 11:
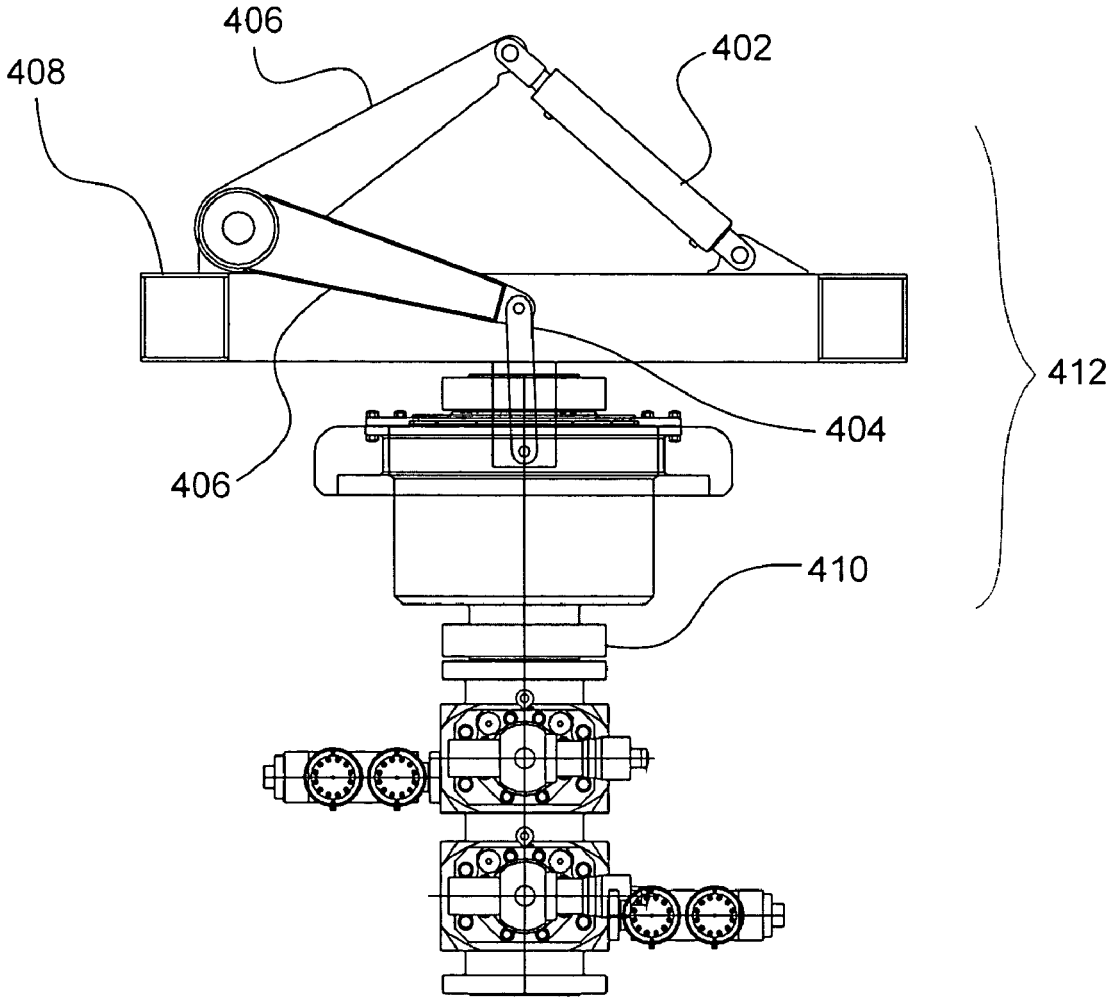
FIG. 11 depicts BOP lifting device.

FIG. 11, shows a side view of an embodiment of the BOP lifting device (412). The lifting device has a lifting arm (406), and a piston (402) connected to the lifting arm (406). The lifting arm (406) pivots at a point attached to the BOP lifting table (408) with a guide (404) connected to the lifting table (408) to guide the vertical lifting of the BOP (410). When the piston (402) extends against the lifting arm (406), the other end of the lifting arm (406) raises the BOP (410).

Figure 12:
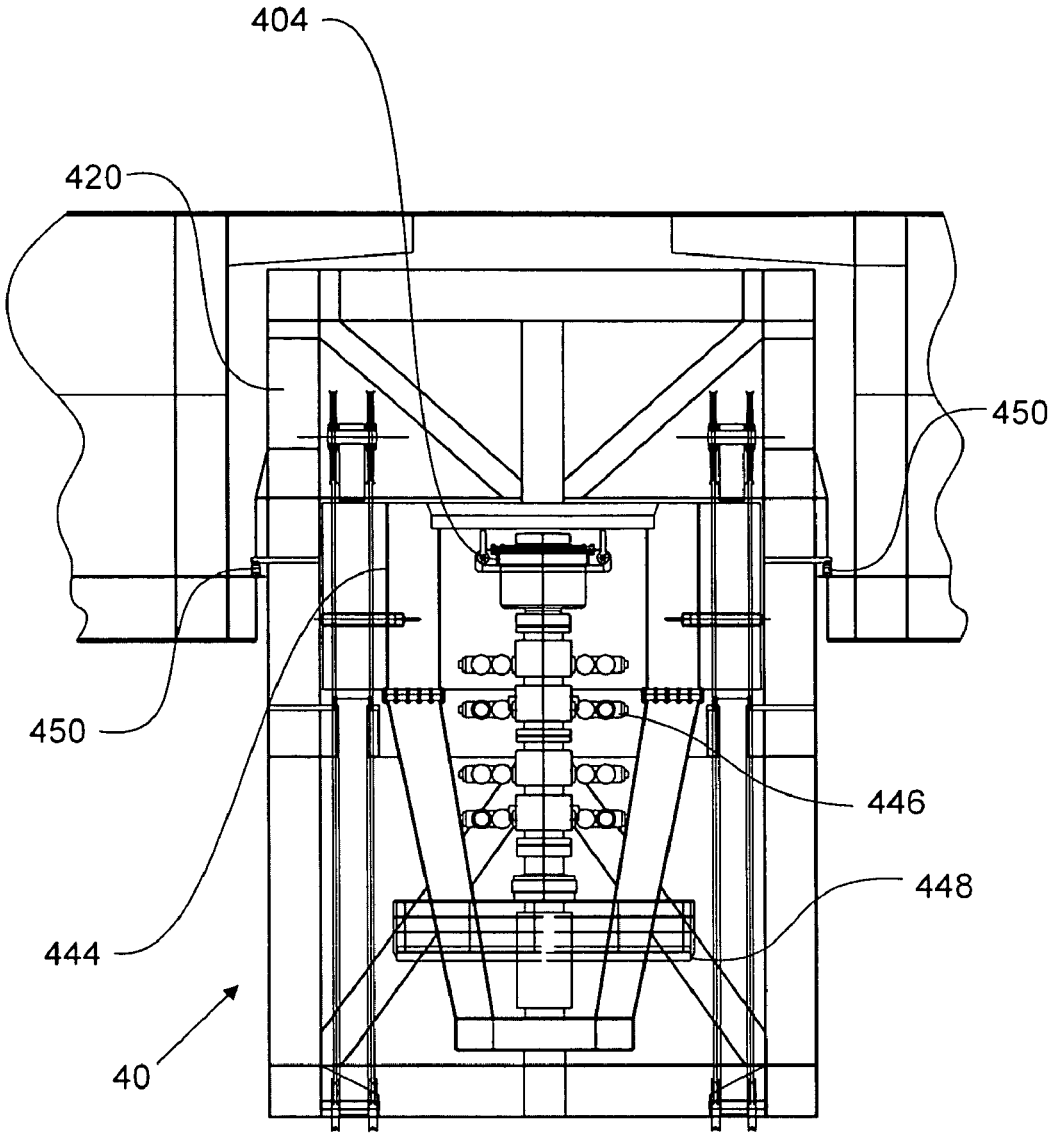
FIG. 12 depicts a side view of the surface BOP handling and tensioning device.

FIG. 12, shows a front view of a M3 device (40) and an embodiment of the BOP lifting device. The BOP support frame (420) of this embodiment can be attached to the drilling platform by rails (450). The BOP support base (444) moves vertically within the BOP support frame (420) to prevent breakage of the casing as the platform moves vertically with the movement of the ocean. The BOP (446) is mounted inside the BOP support base (444). A platform (448) for working on the BOP (446) is shown. The BOP lifting device with guides (404) can be used with both surface and sub-surface BOP units.

Figure 13:
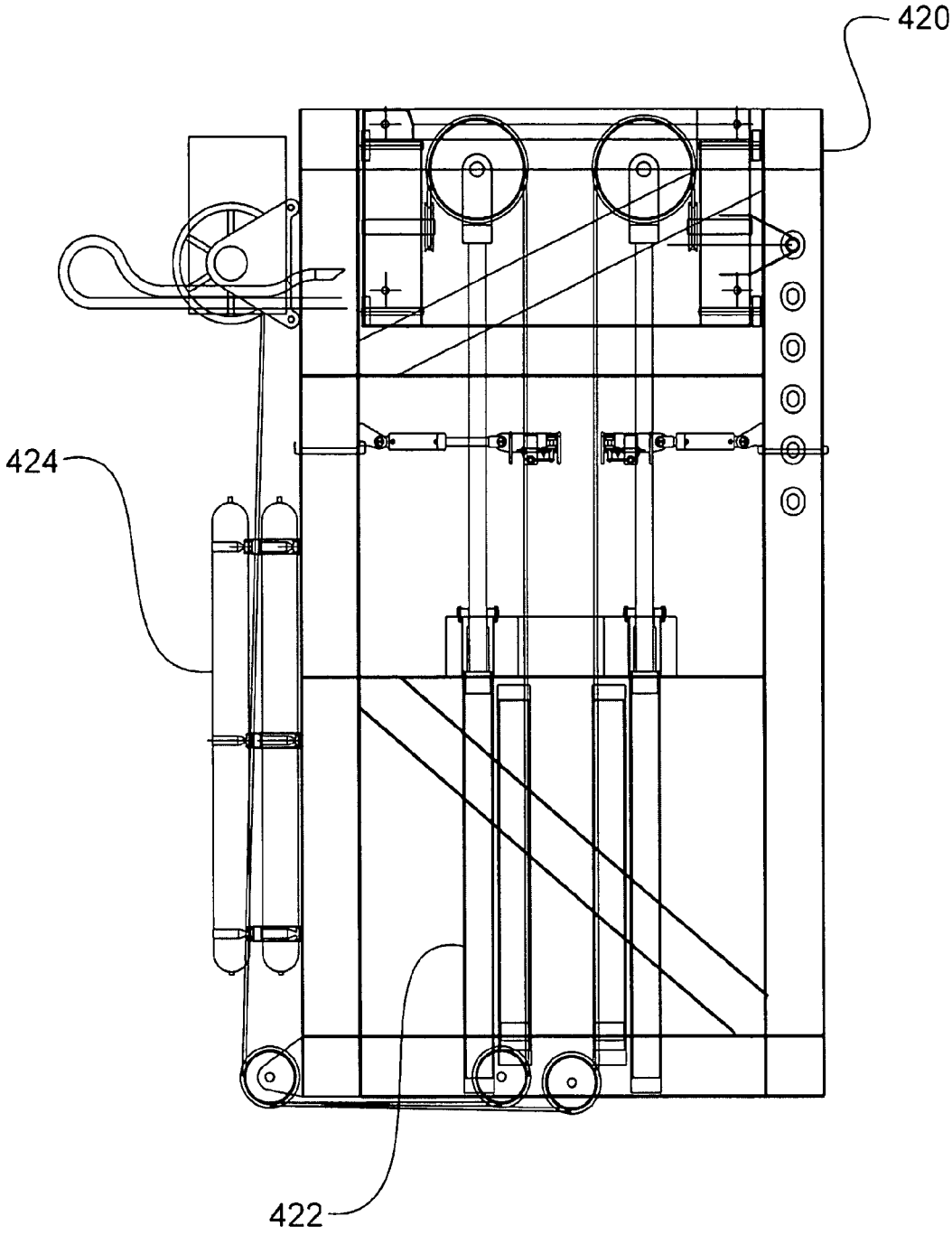
FIG. 13 depicts a front view of the surface BOP handling and tensioning device.

FIG. 13, shows a side view of a M3 device usable herein. In this embodiment a BOP support frame (420) is shown with the gas tanks (424) attached to the BOP support frame (420). The gas tanks are used to raise and lower the gas cylinders (422).

The BOP support frame of FIG. 13 is attached to the floating vessel and moves with the vertical movement of the vessel. The BOP support base remains at a precise height with the use of the gas cylinders and the gas tanks which make up the tensioning system. The BOP must maintain the height because the BOP is connected to the ground or seabed with risers.

The surface BOP, tensioning system, surface wellhead, and stress joints-can be pre-formed as a-one piece unit or M3 unit prior to installation at sea.

It should be noted that in a preferred embodiment, the casing riser stress joint is a tapered steel structure, and the wall thickness of the upper and lower casing riser stress joint connected to the wellhead is thicker than the wall thickness of the riser connected to the upper and lower saver sub or the tubular riser.

FIG. 14, 15, 16, 17, and 18, depict an advantage of a BOP lifting device also referred to as the M3 device. The M3 device is a device that enables the riser and the surface BOP to be skidded in and out of the firing line of the drill rig.

FIGS. 14 to 18 show the skidding of the M3 unit. The M3 unit is depicted as which has a support frame (420).

The skidding allows the attachment of a Christmas tree to a riser while leaving the surface BOP attached to the M3 device. The M3 shifts the riser out of the way saving time while drilling the well. The M3 can also be used for completion work as well. The M3 provides skidding so that multiple wells can be drilled from only one rig without having to retrieve the riser in between drilling operations.

An embodiment of this method contemplates that a drilling rig can have dual drilling floors. An advantage of the M3 device is that only one M3 device would provide skidding in and out of the firing line on both drilling floors without disconnecting the casing and or riser between drilling operations.

Figure 14:
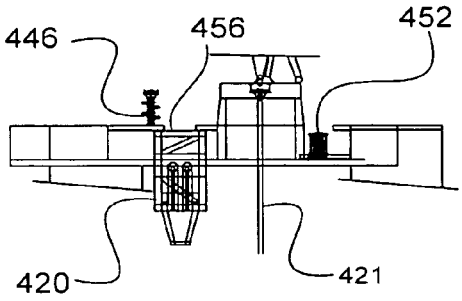
FIG. 14 depicts step one of the handling procedure of a surface BOP when the method of using a surface blow out preventer is deployed.

As shown on FIG. 14 the M3 has a BOP support frame (420) and is in position under a hatch (456). In this position, the M3 is awaiting the installation of a surface BOP (446), and additionally a Christmas tree (452) which can also be installed on the surface or can be landed on the well on the sea floor. In this FIG. 14 a 30 inch conductor casing is shown in the firing line.

Figure 15:
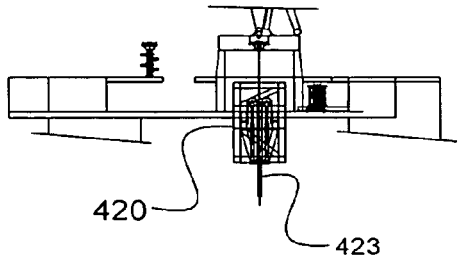
FIG. 15 depicts step two of the handling procedure of a surface BOP when the method of using a surface blow out preventer is deployed.

FIG. 15 depicts an embodiment wherein the M3 (420) is skidded into position, for the running of 20 inch casing and cementing of the 20 inch casing (423) to the well bore and/or 30 inch conductor casing (421).

Figure 16:
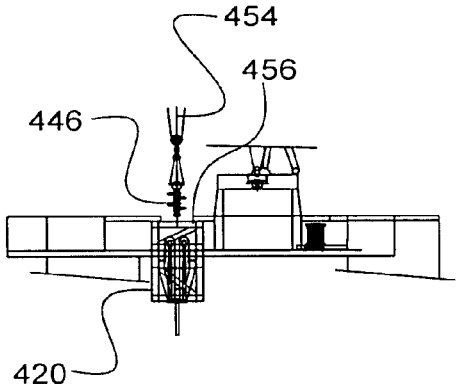
FIG. 16 depicts step three of the handling procedure of a surface BOP when the method of using a surface blow out preventer is deployed.

FIG. 16 depicts an embodiment of the invention wherein a surface BOP (446) is installed in an M3's BOP support frame (420) using a crane (454) after the M3 is skidded back under the hatch (456).

Figure 17:
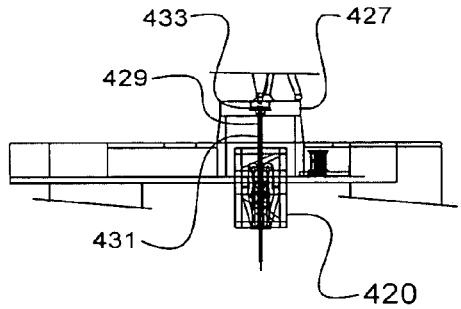
FIG. 17 depicts step four of the handling procedure of a surface BOP when the method of using a surface blow out preventer is deployed.

FIG. 17 depicts an embodiment wherein an M3's BOP support frame (420) is skidded back under a drill floor (427). A slipjoint (429) with a flexjoint (431) and a diverter (433) are shown run into place. Once these elements are in place, a new bore can be drilled.

Figure 18:
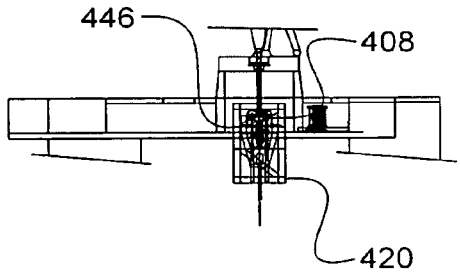
FIG. 18 depicts an embodiment of the disconnect procedure for the surface BOP.

FIG. 18 depicts an embodiment of the method which involves the step of disconnecting a surface BOP (446) from the surface wellhead and then lifting the surface BOP (446) using a BOP lifting table (408). After the surface BOP is disconnected, slips are set and then casing ends are cut off. As an option, after disconnecting, the rig can be ballasted down to achieve an acceptable working elevation.

While this method has been described with emphasis on the preferred embodiments, it should be understood that within the scope of the appended claims, the method might be practiced other than as specifically described herein.

What is claimed is:

1. A method of drilling and completing an underwater well, wherein the method comprises the steps of:

a. installing conductor casing from a floating vessel into a seabed and wherein the floating vessel has a mooring system that can limit excursions to a point that there is no risk of damage to a casing riser;

b. drilling a bore through the conductor casing to a defined depth in the seabed;

c. installing surface casing through the conductor casing, wherein the surface casing comprises a first end and a second end, d. disposing on a first end of the surface casing, a wellhead and a mudline suspension system;

e. connecting the wellhead to a connector which is then connected to a lower stress joint;

f. connecting the lower stress joint to a lower end of a tubular riser;

g. connecting the tubular riser to an upper stress joint;

h. connecting the upper stress joint to a surface wellhead in fluid communication with a surface blow out preventer;

i. connecting the surface blow out preventer and the surface wellhead to a tensioning system on the floating vessel; and j. using a telescoping joint comprising a first joint end and a second joint end, wherein the first joint end connects to the surface blow out perventer and the second joint end connects to the floating vessel.

2. The method of claim 1, further comprising the steps of a. drilling a second bore hole deeper through the surface casing to a second depth;

b. installing a smaller diameter casing comprised of a lower section of smaller diameter casing connected to a mudline suspension hanger which is connected to a upper section of smaller diameter casing, wherein the lower section smaller diameter casing is suspended from the mudline suspension system that is attached to the wellhead that is connected to the first end of the surface casing; and c. installing an upper section smaller diameter casing between the mudline suspension hanger and the surface wellhead, wherein the upper section smaller diameter casing is suspended with a casing hanger from the surface wellhead.

3. The method of claim 2, wherein the steps of drilling to the second bore hole and installing the smaller diameter casing is repeated until the desired depth of the bore hole is achieved.

4. The method of claim 1, further comprising the step of pre-forming the surface wellhead and the upper and the lower stress joints as a one piece unit prior to installation at sea.

5. The method of claim 1, further comprising the step of installing a lower saver sub between the connection of the lower stress joint and a lower end of the tubular riser.

6. The method of claim 1, further comprising the step of installing an upper saver sub between the connection of a upper end of the tubular riser and the upper stress joint.

7. The method of claim 1, wherein the lower stress joint is selected from the group consisting of, rigid stress joint, ball joint and flex joint and combinations thereof.

8. The method of claim 1, wherein the upper stress joint is selected from the group consisting of, rigid stress joint, ball joint and flex joint and combinations thereof.

9. The method of claim 7, wherein the rigid upper stress joint is a tapered steel structure, and the upper rigid stress joint comprises a wall thickness thicker than the upper and lower saver subs or tubular riser.

10. The method of claim 8, wherein the rigid lower stress joint is a tapered steel structure, and the lower rigid stress joint comprises a wall thickness thicker than the upper and lower saver subs or tubular riser.

11. The method of claim 1, further comprising the step of tensioning the surface blow out preventer and the surface wellhead using a tensioning system comprising:

a. a tensioning frame;

b. a tensioning base moveably disposed in the tensioning frame for supporting the surface wellhead and the surface blow out preventer;

c. at least two tensioning cylinders, wherein each tensioning cylinder is connected to the tensioning base and;

d. a BOP lifting table adapted to lift and support the surface BOP from the surface wellhead.

12. The method of claim 11, wherein tensioning of the surface blow out preventer comprises connecting at least two tensioning cylinders to the tensioning base, and wherein sheaves and cables are controlled by the tensioning cylinders to provide a constant tension on the casing riser.

13. The method of claim 11, wherein the tensioning cylinders are selected from the group consisting of, hydraulically operated tensioning cylinders, pneumatically operated cylinders and combinations thereof.

14. The method of claim 11, wherein the tensioning system is gimbaled to minimize the lateral load on the upper and lower stress joints.

15. The method of claim 1, further comprising landing concentrically different diameter casing strings within a housing while supporting the weight of casing strings suspended below using the mudline suspension system.

16. The method of claim 1, further comprising the step of using a low pressure subsea wellhead housing for the subsea wellhead.

17. The method of claim 1, further comprising using a floating vessel with a multipurpose drilling unit.

18. The method of claim 17, wherein the multipurpose unit comprises:

a. a mast comprising two struts, a mast top side, a mast bottom side, a mast forward side, a mast inward side, and a mast back side;

b. a plurality of cable blocks connected to the mast top side;

c. a main trolley comprising a first gripper moveably connected to the mast inward side;

d. at least one main hoist connected to the mast; and e. a hoisting cable connected to the at least one main hoist adapted to be guided over the plurality of cable blocks and adapted to move the main trolley relative to the mast.

19. The method of claim 18, wherein the multipurpose unit is rotatable at the mast bottom side.

20. The method of claim 18, wherein the multipurpose unit further comprises an auxiliary trolley and a least one secondary hoist connected to the mast, wherein the auxiliary trolley is adapted to move relative to the mast, and the auxiliary trolley comprises a second gripper moveably connected to the mast forward side.

21. The method of claim 18, further comprising the step of connecting a compensator to the mast.

22. The method of claim 18, further comprising the step of supporting the cable blocks from the mast top side, and using a lattice structure of the mast top side to support the cable blocks.

23. The method of claim 1, wherein the drilling is casing drilling.

24. The method of claim 1, further comprising the step of installing a mooring system to be used with the drilling system wherein the mooring system comprises:

a. at least eight anchors;

b. at least eight mooring lines, each line consisting of: a first length of steel wire rope secured to each of the anchors; a length of polymer rope secured to each of the first length of steel wire rope; a second length of steel wire rope having a first end and the second end, and wherein the first end is secured to the length of polymer rope and the second end is secured to the floating vessel; and wherein the mooring lines have adequate elasticity, stiffness and strength to accommodate the load on the tender under an environmental load produced by an up to a 10-year storm in the tendering position, and further wherein the mooring lines have a strength to withstand the environmental load produced by up to a 100-year extreme weather condition when the tender is moved to a 100-year extreme weather condition standby position; and the mooring lines of the method are adapted to synchronize the movements between the floating vessel and a deep draft caisson vessel, while tendering.

25. The method of claim 24, wherein the step of installing the mooring system involves using a mooring design engineered to withstand a 100-year storm event.

26. The method of claim 24, wherein the mooring system is stiff enough to minimize floating vessel excursions that apply forces to components between the subsurface wellhead and the surface blow out preventer so that the forces do not exceed any one component's rated working strength or defined fatigue limit.

27. The method of claim 24, wherein the mooring system is secured to a floating platform wherein the floating platform has three columns, and wherein the shape of the floating platform allows for less movement than a similarly sized floating platform and mooring system.

28. The method of claim 1, further comprising the following steps for installing the blow out preventer (BOP):

a. running and jetting a conductor and drilling a smaller open hole through the conductor;

b. skidding a BOP support frame into position for running casing and cementing casing;

c. tensioning the casing using the BOP support frame;

d. skidding the BOP support frame for installing the BOP;

e. installing the BOP in the BOP support frame;

f. skidding the BOP support frame under the drill floor;

g. ruining a slipjoint with a flexjoint and a diverter into place for connecting to the BOP;

h. drilling a second hole;

i. running casing and landing casing on the mudline suspension system;

j. cementing casing below the mudline suspension system;

k. disconnecting the BOP from the surface wellhead and lifting the BOP; and l. setting slips and cutting off casing ends.

29. The method of claim 28, wherein the blow out perventer is a surface blow out perventer.

30. The method of claim 28, wherein the lifting of the BOP, is done by the BOP lifting device comprising:

a. a BOP lifting table;

b. a lifting arm, wherein the lifting arm is connected to the BOP;

c. a piston connected to the lifting arm; wherein the lifting arm pivots at a point attached to a BOP lifting table; and d. a guide connected to the BOP lifting table, wherein the guide is for guiding the vertical movement of the BOP.

31. The method of claim 30, further comprising moving the BOP support base vertically within the BOP support frame.

32. The method of claim 30, further comprising using at least one gas cylinder to facilitate the moving of the BOP support base vertically within the BOP support frame.

33. The method of claim 1, wherein the connector is an H4 connector.

* * * * *